US008857561B2

(12) United States Patent
Abram et al.

(10) Patent No.: US 8,857,561 B2
(45) Date of Patent: Oct. 14, 2014

(54) EXHAUST VALVE COMBINED WITH ACTIVE NOISE CONTROL SYSTEM

(75) Inventors: Kwin Abram, Columbus, IN (US); James Egan, Indianapolis, IN (US)

(73) Assignee: Faurecia Emissions Control Technologies, Columbus, IN (US)

( * ) Notice: Subject to any disclaimer, the term of this patent is extended or adjusted under 35 U.S.C. 154(b) by 0 days.

(21) Appl. No.: 13/884,097

(22) PCT Filed: Oct. 25, 2011

(86) PCT No.: PCT/US2011/057571

§ 371 (c)(1), (2), (4) Date: May 8, 2013

(87) PCT Pub. No.: WO2012/074625

PCT Pub. Date: Jun. 7, 2012

(65) Prior Publication Data

US 2013/0233642 A1 Sep. 12, 2013

Related U.S. Application Data

(60) Provisional application No. 61/418,502, filed on Dec. 1, 2010.

(51) Int. Cl.
*F01N 1/00* (2006.01)

(52) U.S. Cl.
USPC ..... 181/254; 181/237

(58) Field of Classification Search
USPC ..... 181/254, 237
See application file for complete search history.

(56) References Cited

U.S. PATENT DOCUMENTS

| | | | | |
|---|---|---|---|---|
| 5,319,165 | A | 6/1994 | Geddes | |
| 6,454,047 | B1 * | 9/2002 | Galaitsis | 181/254 |
| 6,688,422 | B2 | 2/2004 | Fuesser et al. | |
| 7,401,592 | B2 * | 7/2008 | Willats et al. | 123/323 |
| 7,428,947 | B2 | 9/2008 | Nohl et al. | |
| 7,503,544 | B2 | 3/2009 | Unbehaun et al. | |
| 7,533,759 | B2 * | 5/2009 | Krueger et al. | 181/206 |
| 7,575,096 | B2 | 8/2009 | Arbuckle et al. | |
| 7,628,250 | B2 | 12/2009 | Abram et al. | |
| 8,201,401 | B2 | 6/2012 | Abram et al. | |
| 8,365,522 | B2 | 2/2013 | Abram et al. | |
| 8,453,672 | B2 | 6/2013 | Abram et al. | |
| 2004/0261404 | A1 * | 12/2004 | Vignassa et al. | 60/324 |
| 2006/0272322 | A1 | 12/2006 | Abram et al. | |
| 2007/0062756 | A1 * | 3/2007 | Seibt et al. | 181/206 |
| 2008/0017815 | A1 | 1/2008 | Callahan et al. | |
| 2008/0034743 | A1 | 2/2008 | Abram et al. | |
| 2008/0083218 | A1 | 4/2008 | Abram et al. | |

(Continued)

OTHER PUBLICATIONS

International Search Report from PCT/US2011/057571.

(Continued)

*Primary Examiner* — Forrest M Phillips
(74) *Attorney, Agent, or Firm* — Carlson, Gaskey & Olds, PC

(57) ABSTRACT

A vehicle exhaust system includes at least one exhaust component that defines an exhaust passage from an engine to an exhaust outlet. An active noise attenuation component is associated with the exhaust component. A valve is positioned within the exhaust component downstream of the engine and upstream of the active noise attenuation component. The valve and active noise attenuation component cooperate with each other to control noise generated by the exhaust system.

28 Claims, 1 Drawing Sheet

(56) References Cited

U.S. PATENT DOCUMENTS

| | | | |
|---|---|---|---|
| 2008/0115748 | A1 | 5/2008 | Willats et al. |
| 2008/0116404 | A1 | 5/2008 | Willats et al. |
| 2008/0135029 | A1 | 6/2008 | Speer |
| 2008/0164433 | A1 | 7/2008 | Nohl et al. |
| 2009/0084998 | A1 | 4/2009 | Callahan et al. |
| 2009/0126356 | A1 | 5/2009 | Abram et al. |
| 2009/0126357 | A1 | 5/2009 | Abram |
| 2009/0126358 | A1 | 5/2009 | Abram et al. |
| 2009/0126359 | A1 | 5/2009 | Abram et al. |
| 2009/0127022 | A1 | 5/2009 | Abram et al. |
| 2009/0319160 | A1 | 12/2009 | Callahan et al. |
| 2010/0064673 | A1 | 3/2010 | Hahnl |
| 2010/0192560 | A1 | 8/2010 | Abram et al. |
| 2013/0056083 | A1 | 3/2013 | Abram et al. |

OTHER PUBLICATIONS

U.S. Appl. No. 13/852,230 (not yet published).
U.S. Appl. No. 13/413,053 (not yet published).
U.S. Appl. No. 13/466,172 (not yet upublished).

* cited by examiner

EXHAUST VALVE COMBINED WITH ACTIVE NOISE CONTROL SYSTEM

RELATED APPLICATION

This application claims priority to U.S. Provisional Application No. 61/418,502, filed Dec. 1, 2010.

TECHNICAL FIELD

This invention generally relates to a vehicle exhaust system with active noise control, and more specifically relates to an exhaust system that combines a valve with an active noise control system to improve reduction of low frequency noise.

BACKGROUND OF THE INVENTION

Active noise control systems are used in many vehicle exhaust systems to control a level of sound generated by the exhaust system. Noise attenuation difficulties arise for controlling high level sounds at very low frequencies. This combination requires a very large noise cancelling driver in order to effectively reduce or cancel the exhaust sound. This disadvantageously requires a significant amount of packaging space, in addition to increasing cost and weight.

SUMMARY OF THE INVENTION

A vehicle exhaust system uses a combination of an exhaust valve and an active noise control component or system to control noise generated by the exhaust system.

In one example, a vehicle exhaust system includes at least one exhaust component that defines an exhaust passage from an engine to an exhaust outlet. An active noise attenuation component is associated with the exhaust component. A valve is positioned within the exhaust component downstream of the engine and upstream of the active noise attenuation component.

In one example, the valve is actively controlled by a controller to move a valve body between open and closed positions.

In another example, the valve is a passive valve whose opening movement is solely controlled by exhaust gas flow pressure.

In one example, the active noise attenuation component comprises a speaker having an output controlled by a controller.

These and other features of the present invention can be best understood from the following specification and drawings, the following of which is a brief description.

DETAILED DESCRIPTION

Figure 1:
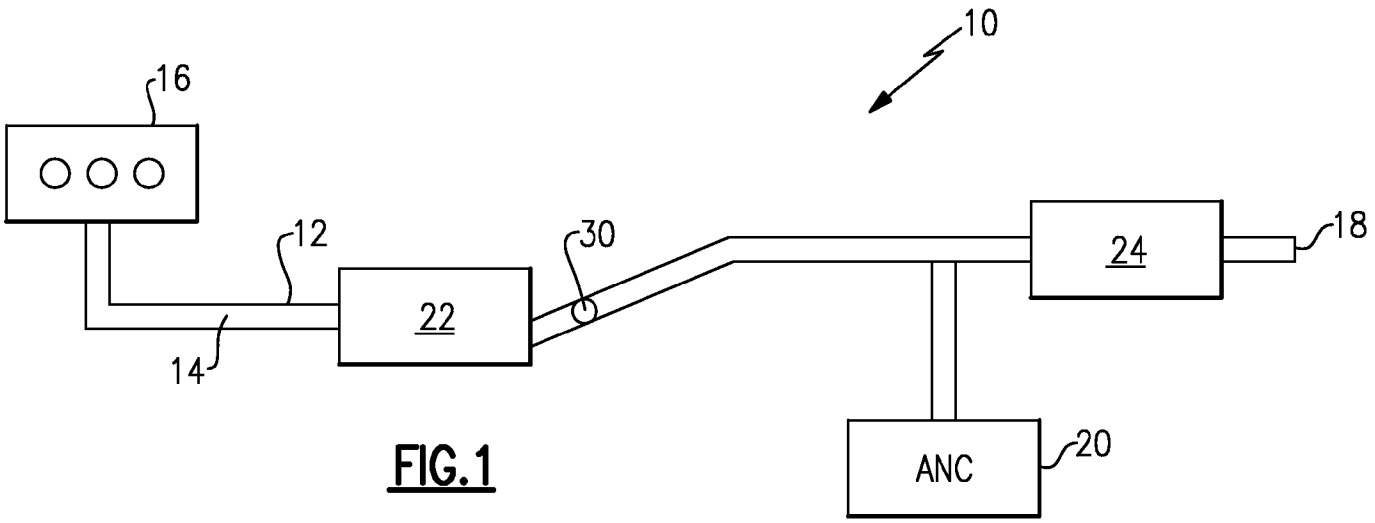
FIG. 1 is a schematic view of a vehicle exhaust system incorporating the subject invention.

A vehicle exhaust system 10 includes an exhaust component 12 that defines an exhaust gas passage 14 that extends from an engine 16 to an exhaust outlet 18 at a tailpipe, for example. The exhaust component 12 is comprised of one or more exhaust tubes or exhaust pipes that are connected to each other and to other exhaust system components to define the exhaust gas passage 14.

An active noise control component or system 20 is associated with the exhaust component 12. In certain configurations, one or more optional exhaust components 22 may be positioned in the exhaust component 12 upstream of the active noise control system 20. In addition to, or optionally, one or more exhaust components 24 may be positioned in the exhaust component 12 downstream of the active noise control system 20. These exhaust components 22, 24 could comprise mufflers, resonators, converters, etc., for example.

A valve 30 is positioned within the exhaust component 12 at a position that is downstream of the engine 16 and upstream of the active noise control system 20. The valve 30 is positioned within the exhaust tube in a non-bypass configuration such that all exhaust gas must pass through the valve 30 before exiting the outlet 18. Exhaust system components may or may not be located between the engine 16 and the valve 30 and/or between the valve 30 and the active noise control system 20. The valve 30 and active noise control system 20 cooperate with each other to control noise generated by the exhaust system 10.

Figure 2:
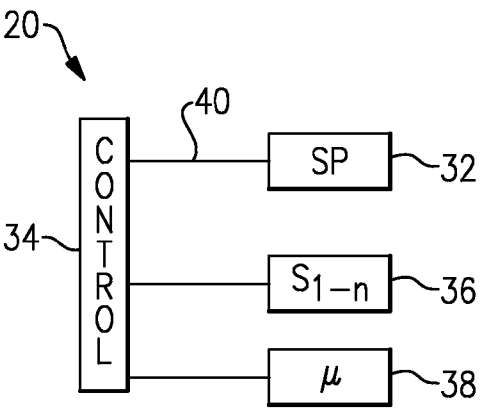
FIG. 2 is a schematic representation of one example of an active noise attenuation system.

Any type of active noise control system 20 can be used within the vehicle exhaust system 10; however, the active noise control system 20 must be able to provide active sound cancelling and/or sound enhancement. In one example shown in FIG. 2, the active noise control system 20 includes a speaker 32 and a controller 34. The active noise control system 20 may optionally include one or more sensors 36 and/or a microphone 38 that communicate exhaust or sound characteristics to the controller 34. The controller 34 then generates a control signal 40 that causes the speaker 32 to generate an out of phase sound that cancels out an exhaust system generated noise as known.

By combining an active noise control system 20 with a valve 30 located within the exhaust component 12, it allows the overall size of the active noise control system 20 to be made very compactly. Further, by reducing the size, the energy required to power the active noise control system 20 can be significantly reduced.

Figure 3:
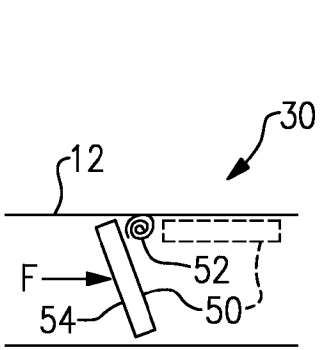
FIG. 3 is a schematic representation of a passive valve assembly.

The valve 30 is comprised of a valve body 50 that is positioned within the exhaust tube component 12. In one example, the valve 30 comprises a passive valve that is moveable through various positions between a closed position where a significant portion of the passage is blocked by the valve body 50 (as shown in FIG. 3) and an open position (shown in dashed lines). The valve body 50 is typically biased by a resilient member 52 to the closed position. Movement of the valve body 50 toward the open position is solely dependent upon pressure exerted by exhaust gas flow F against an upstream face 54 of the valve body 50. As a pressure of the exhaust gas flow F increases sufficiently to overcome the biasing force of the resilient member 52, the valve body 50 can be moved into the open position. One example of a passive valve is described in U.S. Pat. No. 7,628,250 which is assigned to the owner of the present invention and which is herein incorporated by reference.

Figure 4:
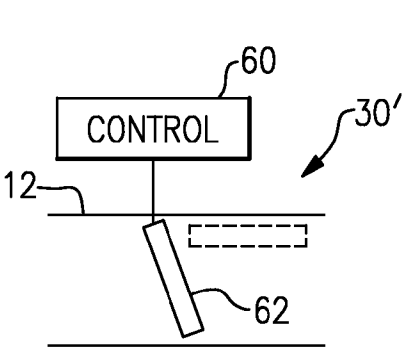
FIG. 4 is a schematic representation of an actively controlled valve assembly.

In another example shown in FIG. 4, the valve 30 comprises an actively controlled valve that is moveable through various positions between an open position (dashed lines) and closed position by a controller 60. The actively controlled valve includes a valve body 62 that is moved and held in various positions in response to control signals generated by the controller 60. Disadvantages with an actively controlled valve compared to a passive valve include increased weight and size, as well as a higher cost.

By implementing a valve 30 upstream of active noise cancelling within the exhaust system 10, the low frequency content of the exhaust generated sound will be substantially reduced. This leave high frequency noise attenuation to be addressed by active noise cancelled. Because lower frequency noise is addressed by the valve, the active noise control system can use a "driver", e.g. a speaker, for noise cancelling that is smaller, lighter, less expensive, and which requires less energy as compared to configurations where all ranges of noise are addressed by the active noise control system.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A vehicle exhaust system comprising:

at least one exhaust component defining an exhaust passage from an engine to an exhaust outlet;

an active noise attenuation component associated with said at least one exhaust component; and a valve positioned within said at least one exhaust component downstream of the engine and upstream of said active noise attenuation component.

2. The vehicle exhaust system according to claim 1 wherein the valve is the only valve associated with the active noise control system to attenuate noise.

3. The vehicle exhaust system according to claim 1 wherein the at least one exhaust component comprises an exhaust pipe defining a sole exhaust gas path between an upstream exhaust component and a downstream exhaust component, and wherein the active noise control system is associated with the exhaust pipe at a first location between the upstream and downstream exhaust components, and wherein the valve is positioned within the exhaust pipe at a second location upstream of the first location in a non-bypass configuration such that all engine exhaust gas flows first through the second location and then past the first location before entering the downstream exhaust component.

4. The vehicle exhaust system according to claim 3 wherein the valve is the only valve mounted within the exhaust pipe between the upstream and downstream components.

5. The vehicle exhaust system according to claim 1 wherein said valve comprises a passive valve.

6. The vehicle exhaust system according to claim 5 wherein said passive valve is resiliently biased to a closed position and wherein opening movement of said passive valve toward an open position is solely controlled by exhaust gas flow.

7. The vehicle exhaust system according to claim 1 wherein said valve comprises an actively controlled valve that is responsive to a control signal.

8. The vehicle exhaust system according to claim 1 wherein said active noise attenuation component comprises a controller and a speaker.

9. The vehicle exhaust system according to claim 8 wherein said speaker generates an out of phase noise to cancel an exhaust system generated noise in response to a control signal generated by said controller.

10. The vehicle exhaust system according to claim 1 including a muffler positioned upstream of said valve.

11. The vehicle exhaust system according to claim 1 including a muffler positioned downstream of said active noise control component.

12. The vehicle exhaust system according to claim 1 wherein said valve reduces low frequency noise generated by the exhaust system and said active noise attenuation component attenuates high frequency noise generated by the exhaust system.

13. The vehicle exhaust system according to claim 1 wherein said at least one exhaust component comprises an exhaust tube.

14. The vehicle exhaust system according to claim 13 wherein said valve is positioned within said exhaust tube in a non-bypass configuration, and including a first additional exhaust component positioned upstream of said valve and a second additional exhaust component positioned downstream of said valve.

15. The vehicle exhaust system according to claim 13 wherein said active noise attenuation component comprises a controller, a speaker, and at least one sensor and/or microphone that communicates exhaust or sound characteristics to the controller, and wherein said speaker generates an out of phase noise to cancel an exhaust system generated noise in response to a control signal generated by said controller.

16. The vehicle exhaust system according to claim 15 wherein said valve comprises an actively controlled valve that is responsive to a control signal.

17. The vehicle exhaust system according to claim 15 wherein said valve comprises a passive valve that is resiliently biased to a closed position, and wherein opening movement of said passive valve toward an open position is solely controlled by exhaust gas flow pressure, and wherein said passive valve is positioned within said exhaust tube in a non-bypass configuration, and including a first additional exhaust component positioned upstream of said valve and a second additional exhaust component positioned downstream of said valve.

18. A vehicle exhaust system comprising:

an exhaust tube defining an exhaust passage to conduct exhaust gases from an engine to an exhaust outlet;

an active noise attenuation component associated with said exhaust tube; and a valve positioned within said exhaust tube downstream of the engine and upstream of said active noise attenuation component, wherein said valve is configured to attenuate low frequency noise generated by the exhaust system and said active noise attenuation component is configured to attenuate high frequency noise generated by the exhaust system.

19. The vehicle exhaust system according to claim 18 wherein the valve is the only valve associated with the active noise control system to attenuate noise.

20. The vehicle exhaust system according to claim 18 wherein the exhaust tube defines a sole exhaust gas path between an upstream exhaust component and a downstream exhaust component, and wherein the active noise control system is associated with the exhaust tube at a first location between the upstream and downstream exhaust components, and wherein the valve is positioned within the exhaust tube at a second location upstream of the first location in a non-bypass configuration such that all exhaust gases from the engine flow first through the second location and then past the first location before entering the downstream exhaust component.

21. The vehicle exhaust system according to claim 20 wherein the valve is the only valve mounted within the exhaust tube between the upstream and downstream components.

22. A method of controlling noise generated by a vehicle exhaust system comprising the steps of:

(a) providing an exhaust component defining an exhaust gas passage extending from an engine to an exhaust outlet;

(b) associating an active noise control system with the exhaust component; and (c) positioning a valve downstream of the engine and upstream of the active noise control system such that the valve and active noise control system cooperate with each other to control noise generated by the vehicle exhaust system.

23. The method according to claim 22 wherein the valve is resiliently biased to a closed position and including solely moving the valve toward an open position in response to exhaust gas flow pressure sufficient to overcome a biasing force applied to the valve.

24. The method according to claim 22 including actively controlling movement of the valve.

25. The method according to claim 22 wherein the active noise control system includes at least a speaker and a controller, and including generating an out of phase noise with the speaker to cancel an exhaust system generated noise in response to a control signal generated by the controller.

26. The method according to claim 22 including attenuating low frequency noise with the valve and attenuating high frequency noise with the active noise control system.

27. The method according to claim 22 wherein the valve is the only valve associated with the active noise control system to attenuate noise.

28. The method according to claim 22 wherein the exhaust component comprises an exhaust pipe defining a sole exhaust gas path between an upstream exhaust component and a downstream exhaust component, and wherein step (b) includes associating the active noise control system with the exhaust pipe at a first location between the upstream and downstream exhaust components; and step (c) includes positioning the valve within the exhaust pipe at a second location upstream of the first location in a non-bypass configuration such that all exhaust gas flows first through the second location and then past the first location before entering the downstream exhaust component.

* * * * *